US006101657A

United States Patent [19]

Hamilton

[11] Patent Number: 6,101,657

[45] Date of Patent: Aug. 15, 2000

[54] APPLICATOR HAVING AN EXTENSION

[76] Inventor: Andrew Hamilton, P.O. Box 24893, Los Angeles, Calif. 90024

[21] Appl. No.: 08/511,192

[22] Filed: Aug. 4, 1995

[51] Int. Cl.[7] ..... A46B 7/02; B25G 1/04; B25G 3/30

[52] U.S. Cl. ..... 15/145; 15/143.1; 15/160; 16/114 R; 294/57; 294/58; 81/489; 81/177.1; 81/177.2

[58] Field of Search ..... 15/143.1, 145, 15/144.1, 144.2, 144.3, 144.4, 159.1, 160; 16/114 R, 115; 294/57, 58; 81/491, 489, 177.1, 177.2

[56] References Cited

U.S. PATENT DOCUMENTS

| | | | |
|---|---|---|---|
| 85,956 | 1/1869 | Pinkham | 294/58 |
| 2,536,607 | 1/1951 | Jenkins | 16/114 R |
| 3,197,795 | 8/1965 | Forte | 15/145 |
| 3,737,187 | 6/1973 | Pryor | 15/144.1 |
| 3,773,375 | 11/1973 | Nehls | 15/144.1 |
| 4,000,537 | 1/1977 | Woo | 15/144.3 |
| 4,157,598 | 6/1979 | Talent et al. | 15/144.3 |
| 4,644,740 | 2/1987 | Lee | 294/58 |
| 4,958,407 | 9/1990 | Johnson | 15/144.1 |
| 5,065,475 | 11/1991 | Watt | 15/145 |
| 5,319,824 | 6/1994 | Cook, III | 15/144.1 |

*Primary Examiner*—Gary K. Graham
*Attorney, Agent, or Firm*—Alfred F. Hoyte, Jr.

[57] ABSTRACT

A paintbrush connectable to an extension is provided. The paintbrush has a threaded bore for threaded engagement with an extension pole. At least one handle having a sleeve portion can be slid over the extension pole and secured thereto to facilitate more accurate control of the paintbrush. The handle is infinitely adjustable along the length of the extension pole.

4 Claims, 1 Drawing Sheet

APPLICATOR HAVING AN EXTENSION

BACKGROUND OF THE INVENTION

1. Field of the Invention

The present invention relates to extensions for applicators. More specifically, it relates to an improved paint brush having an extension.

Thus it can be seen that the potential fields of use for this invention are myriad and the particular preferred embodiment described herein is in no way meant to limit the use of the invention to the particular field chosen for exposition of the details of the invention.

A comprehensive listing of all the possible fields to which this invention may be applied is limited only by the imagination and is therefore not provided herein. Some of the more obvious applications are mentioned herein in the interest of providing a full and complete disclosure of the unique properties of this previously unknown general purpose article of manufacture. It is to be understood from the outset that the scope of this invention is not limited to these fields or to the specific examples of potential uses presented hereinafter.

2. Description of the Prior Art

Devices for extending the reach of various types of applicators are old and well known in the art. Recently, many types of extensions for paint brush rollers have been developed. The following known prior art has been directed to providing a summary of the devices of the prior art. As will be seen, the simplicity and effectiveness of my invention is not rivaled in the prior art.

U.S. Pat. No. 3,866,257, issued to Cansdale, Sr. on Feb. 18, 1975, shows a swivel top paint roller with an adjustable handle. The device is specifically designed for use with rollers.

U.S. Pat. No. 3,984,892, issued to Kyriakou on Oct. 12, 1976 shows a paint brush and scraper holder. The device has a combination brush/scraper rotatably connected to the end of an extension pole. By contrast, the device of the instant invention holds a single brush or applicator and includes a hand grip to increase control over the placement of the brush or applicator.

U.S. Pat. No. 4,325,157, issued to Balint et al. on Apr. 20, 1982, shows an extension handle for use with, e.g., a paint roller. The device can be adjustably extended or retracted to a discrete number of positions. By contrast, the device of the instant invention has an adjustable hand grip which is infinitely adjustable over the length of the extension pole.

U.S. Pat. No. 4,524,484, issued to Graham on Jun. 25, 1985, shows an extension handle having telescoping first and second pole members which are releaseably, lockably connected. By contrast, the device of the instant invention has an extension handle and an outwardly extending hand grip with the hand grip being adjustable along the length of the extension handle.

None of the above inventions and patents, taken either singly or in combination, is seen to describe the instant invention as claimed.

SUMMARY OF THE INVENTION

Briefly, the invention comprises a paintbrush adapted for connection to an extension. The paintbrush has a threaded bore for threaded engagement with an extension pole. A hand grip having a sleeve portion can be slid over an extension pole and secured thereto to facilitate more accurate control of the paintbrush. The hand grip is infinitely adjustable along the length of the extension pole.

Accordingly, it is a principal object of the invention to provide a new and improved paintbrush which overcomes the disadvantages of the prior art in a simple but effective manner.

It is a major object of this invention to provide an applicator adapted for attachment to an extension.

It is another object to provide a paintbrush having a handle adapted for connection to an extension.

It is another object of the invention to provide an extension for a paintbrush which is inexpensive and simple in construction.

It is another object of the invention to provide an extension for a paintbrush which allows for more accurate placement of the paintbrush.

Finally, it is a general goal of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

The present invention meets or exceeds all the above objects and goals. Upon further study of the specification and appended claims, further objects and advantages of this invention will become apparent to those skilled in the art.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
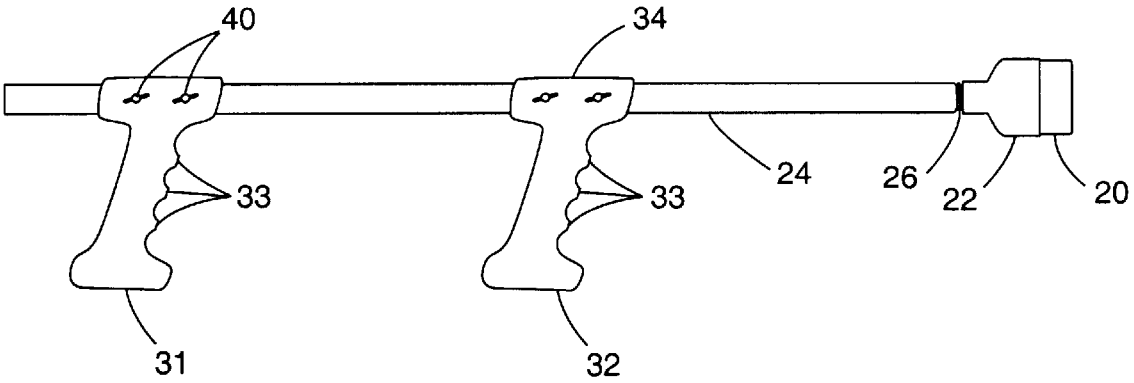
FIG. 1 shows a side view of the paintbrush with extension of the present invention.
Figure 2:
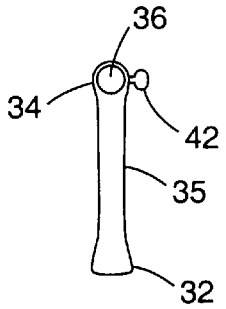
FIG. 2 shows a rear view of the adjustable handle.

Referring to FIGS. 1 and 2 the paint brush with extension, generally indicated by the numeral 10 is shown. The device comprises a paintbrush 20, the paintbrush 20 having an elongated handle 22. The handle 22 may be made of wood or a durable, rigid polymer plastic. The paintbrush handle 22 having a central bore (not shown) formed therein. The bore may be threaded.

An extension pole 24 has a threaded end 26 for connection within the central bore. The extension pole 24 may be made of wood but is preferably a hollow, rigid polymer plastic. A substantial weight saving can be obtained by using the hollow polymer plastic, with the weight saving resulting in less fatigue on the part of the user. Any type of connector may be used to connect the brush 20 to the extension pole 24 such as a bayonet type of connector which could be formed by using a pair of L-shaped tracks in place of the threads in the bore of the paintbrush handle 22. The extension pole 24 could be provided with a pair of mutually opposed projections in place of the external threads which could be aligned with the L-shaped tracks, the extension pole 24 being connected to the paintbrush handle 22 using an insert and twist motion. Alternatively, both the bore and the end of the extension pole 24 could be relatively smooth, and connection of the brush 20 to the extension pole 24 could be by frictional fit.

It should be noted that the extension pole 24 could be of the type currently used as an extension pole for paint rollers. Also, the extension pole 24 could be of the telescoping extending type.

A pair of adjustable hand grips 30 and 31 are attached to the extension pole 24. The hand grips 30 and 31 are provided to increase the amount of control the user has over the placement of the brush 20. It can be readily appreciated that when using a roller with an extension pole, or for that matter, a brush with a relatively short extension pole, control over the applicator is either not very critical, or is not very difficult. When using a brush with a long extension pole however, control over placement can become very difficult. In high ceiling areas, especially over stairs, it can be virtually impossible to use a ladder and therefore some type of extension pole must be used. As is known in the trade, painting ceilings is often made very difficult due to the fact that the ceiling is of a different color that the wall. Thus a brush is necessary for painting the edge areas where the ceiling meets the wall, and placement of the brush is critical to avoid getting the wrong color paint on the wall or ceiling.

The hand grips 30 and 31 provide increased control over the devices of the prior art by allowing the user to support the extension pole 24 with one hand, while aiming the extension pole 24 with the other hand. Preferably the hand grips 30 and 31 have a plurality of finger shaped identations 33. The hand grips 30 and 31 have an integral, radially expanded base 32 connected to its substantially cylindrical main body 35. The base 32 allows the user to make downward strokes of the brush 20 without having his hand accidentally slip off the hand grips 30 and 31. The hand grips 30 and 31 also have a sleeve portion 34 having an axial bore 36, the bore 36 being adapted to allow the hand grips 30 and 31 to slide axially along the length of the extension pole 24.

The hand grips 30 and 31 has two apertures 40 for receiving screws 42 which secure the hand grips 30 and 31 to the extension pole 24. The screws 42 can be loosened to allow for repositioning the hand grips 30 and 31 at any position along the length of the extension pole. If the extension pole 24 is of the telescoping type, the screws 42 should be long enough to compensate for the reduced diameter of the inner telescoping members. In an alternative embodiment, the main body 33 of the hand grip can be made to rotate relative the sleeve portion 34. This would allow the user to hold the hand grips 30 and 31 steady with one hand while moving the extension pole 24 with the other hand.

In operation, after attaching the proper sized paintbrush 20 or other applicator to the threaded end 26 of the extension pole 24, the hand grips 30 and 31 can be adjusted to a position the user feels is comfortable for performing a particular task. The hand grips 30 and 31 can be repositioned as necessary to allow for changes in the users position or the surface area to be painted.

It is to be understood that the provided illustrative examples are by no means exhaustive of the many possible uses for my invention.

From the foregoing description, one skilled in the art can easily ascertain the essential characteristics of this invention and, without departing from the spirit and scope thereof, can make various changes and modifications of the invention to adapt it to various usages and conditions. For example, the artisan could easily attach a different type of applicator to the extension pole.

It is to be understood that the present invention is not limited to the sole embodiment described above, but encompasses any and all embodiments within the scope of the following claims:

I claim:

1. A paintbrush assembly comprising a paintbrush having an elongated handle with an interiorly threaded central bore in one end, said paintbrush being removably connected to an extension member;

said extension member having first and second ends, said first end being substantially smooth and said second end being externally threaded and sized for threaded engagement within said interiorly threaded bore;

a pair of hand grips adjustably secured to said extension member, each of said hand grips having a substantially cylindrical main body defining an axis, with first and second ends, said first end having a radially expanded base, said second end terminating in a sleeve portion sized to fit over the extension member, the sleeve portion including means for securing the sleeve portion to said extension member, adjustment means for allowing variable positioning of said hand grips along said extension member.

2. The assembly of claim 1 wherein the main body of one of said hand grips is rotatable relative to said sleeve portion.

3. The assembly of claim 2 wherein said handgrips are substantially identical.

4. The assembly of claim 1 wherein said handgrips are identical.

* * * * *